US010183846B2

(12) United States Patent
Bøgh-Sørensen et al.

(10) Patent No.: US 10,183,846 B2
(45) Date of Patent: Jan. 22, 2019

(54) ARRANGEMENT FOR SECURE TRANSFER OF A TRAVELLING TROLLEY BETWEEN A FIRST AND A SECOND RAIL IN A HOISTING SYSTEM

(71) Applicant: V. GULDMANN A/S, Aarhus N (DK)

(72) Inventors: Ole Bøgh-Sørensen, Hornslet (DK); Johnni Stræde, Aarhus C (DK); Holger Søe Plougsgaard, Egå (DK)

(73) Assignee: V. GULDMANN A/S, Aarhus N (DK)

( * ) Notice: Subject to any disclaimer, the term of this patent is extended or adjusted under 35 U.S.C. 154(b) by 200 days.

(21) Appl. No.: 15/323,543

(22) PCT Filed: Jul. 2, 2015

(86) PCT No.: PCT/DK2015/050200
§ 371 (c)(1),
(2) Date: Jan. 3, 2017

(87) PCT Pub. No.: WO2016/004953
PCT Pub. Date: Jan. 14, 2016

(65) Prior Publication Data

US 2017/0137264 A1 May 18, 2017

(30) Foreign Application Priority Data

Jul. 10, 2014 (DK) ..... 2014 70432

(51) Int. Cl.
*B66C 7/14* (2006.01)
*A61G 7/10* (2006.01)
*B66C 7/16* (2006.01)

(52) U.S. Cl.
CPC ..... *B66C 7/14* (2013.01); *A61G 7/1042* (2013.01); *A61G 7/1063* (2013.01); *B66C 7/16* (2013.01)

(58) Field of Classification Search
CPC .... B66C 7/02; B66C 7/14; B66C 7/16; A61G 7/1042; A61G 7/1063
(Continued)

(56) References Cited

U.S. PATENT DOCUMENTS 1,612,217 A * 12/1926 Phillips ..... B65G 9/008 104/98
1,640,344 A * 8/1927 Bennington ..... B66C 7/14 104/103
(Continued)

FOREIGN PATENT DOCUMENTS

DK 176035 B1 1/2006
FR 2223297 A1 10/1974
(Continued)

OTHER PUBLICATIONS

International Preliminary Report on Patentability for PCT/DK2015/050200; 6 pgs.
Written Opinion for PCT/DK2015/050200; 4 pgs.

*Primary Examiner* — Zachary L Kuhfuss
(74) *Attorney, Agent, or Firm* — Schmeiser, Olsen & Watts, LLP

(57) ABSTRACT

An arrangement for secure transfer of a travelling trolley between a first and a second rail in a hoisting system is provided. The arrangement including: a first and a second engagement devices are arranged to engage when the rails are aligned; a third and a fourth engagement devices are arranged to engage when the rails are aligned; a pivotable stop which in a closed position is arranged to form a barrier in the path of the trolley, and which is coupled with the first engagement device such that the first stop is pivoted out of the path of the trolley when the first and the second engagement devices engage, such that the trolley can pass between
(Continued)

the rails; a pivotable second stop which in a closed position is coupled with the third engagement device.

6 Claims, 5 Drawing Sheets

(58) Field of Classification Search
USPC ..... 104/98
See application file for complete search history.

(56) References Cited

U.S. PATENT DOCUMENTS

| | | | | | |
|---|---|---|---|---|---|
| 1,841,454 | A * | 1/1932 | Robertson | E01B 25/12 | 104/98 |
| 2,383,051 | A | 8/1945 | Everard | | |
| 3,132,598 | A * | 5/1964 | Pearson | B66C 7/14 | 104/98 |
| 3,468,264 | A | 9/1969 | Horompo | | |
| 5,784,965 | A * | 7/1998 | Zaguroli, Jr. | E01B 25/26 | 104/251 |
| 2015/0166084 | A1* | 6/2015 | Brannstrom | B66C 7/14 | 104/102 |
| 2018/0153754 | A1* | 6/2018 | Bolin | A61G 7/1042 | |

FOREIGN PATENT DOCUMENTS

| | | | |
|---|---|---|---|
| GB | 703061 | A | 1/1954 |
| GB | 711857 | A | 7/1954 |
| JP | H0881175 | A | 3/1996 |
| WO | WO2013122538 | A1 | 8/2013 |

* cited by examiner

ARRANGEMENT FOR SECURE TRANSFER OF A TRAVELLING TROLLEY BETWEEN A FIRST AND A SECOND RAIL IN A HOISTING SYSTEM

CROSS-REFERENCE TO RELATED APPLICATIONS

This application claims priority to PCT Application No. PCT/DK2015/050200 having a filing date of Jul. 2, 2015, based on DK PA 2014 70432 having a filing date of Jul. 10, 2014, the entire contents of which are hereby incorporated by reference.

FIELD OF TECHNOLOGY

The following concerns an arrangement for secure transfer of a travelling trolley between a first and a second rail in a hoisting system, the arrangement including:

- a first stop which in an open position is arranged to allow passage of the trolley from the first rail to the second rail when the rails are aligned, and which in a closed position is arranged to form a barrier in the path of the trolley, preventing passage of the trolley past the free end of the first rail when the rails are not aligned;
- a second stop which in an open position is arranged to allow passage of the trolley from the second rail to the first rail when the rails are aligned, and which in a closed position is arranged to form a barrier in the path of the trolley, preventing passage of the trolley past the free end of the second rail when the rails are not aligned;
- a first and a second engagement means arranged to engage when the rails are aligned;
- a third and a fourth engagement means arranged to engage when the rails are aligned;
- the first stop arranged so as to pivot in relation to the first rail, and such that the first stop is coupled with the first engagement means so that the first stop pivots out of the path of the trolley when the first and second engagement means engage;
- the second stop arranged so as to pivot in relation to the second rail, and such that the second stop is coupled with the third engagement means so that the second stop pivots out of the path of the trolley when the third and fourth engagement means engage.

BACKGROUND

In hospitals and care centres, overhead hoisting systems are used for transporting patients and occupants that are physically handicapped to some degree.

The hoisting systems include a rail system consisting or including of one or more rails mounted at the ceiling. A sling or carrying strap for a person is suspended from a trolley which can run in the rail system.

The rail system may e.g. include or consist of stationary rails that are fixed and mobile rails that are movable. In this way it is possible to move the trolley and thereby a person suspended in the hoisting system from a first stationary rail via one or more mobile rails to a second stationary rail. The mobile rail used for the transfer is placed such that it is aligned with the first stationary rail. The trolley can then pass beyond the free end of the first stationary rail and over on the mobile rail. The mobile rail with the trolley is then moved to a position where the mobile rail is aligned with the second stationary rail, after which the trolley can be transferred to the second stationary rail.

The above procedure implies that the rails of the rail system are to have free ends which the trolley can pass. A safety problem arises hereby, as it will be possible for the trolley inadvertently to pass beyond the free end of a rail which is not aligned with another rail, with the consequent risk of personal injury and material damage.

Therefore, it is necessary to prevent the passage of the trolley beyond the free end of a rail which is not aligned with another rail. This may, for example, be provided by inserting a physical barrier in the path of the trolley near the free end of the rail. In order to prevent the possibility of errors it is desirable that the barrier is inserted and removed automatically.

An example of such a system is known from WO 2013/122538 A1 which indicates an arrangement for secure transfer of a trolley from one suspended rail to another. The arrangement includes two locking elements, each disposed at the free end of two rails. The locking element includes a rod which is vertically displaceable in a guideway between an upper and a lower position. In the lower position, the rod has a part placed in the path of the trolley, whereas in the upper position, the rod is outside the path of the trolley. The rod includes a horizontal journal with a wheel facing the free end of the rail. The locking elements each include a curving track adapted to engage the wheel of the opposing locking element. The track is designed such that the rod is lifted to its upper position when the rails are aligned, whereas the rod is lowered to its lower rail when the rails are offset. The free end is hereby blocked when the rails are offset, and the trolley is thereby prevented from inadvertently passing the free end of the rails, whereas the blockage is removed when the rails are aligned, such that the trolley can be safely transferred from one rail to the other.

Furthermore, from GB 711857 A and GB 703061 A are known arrangements of the kind mentioned in the introduction. In these documents there is no explanation about limitation as to the number of movable parts in order to improve reliability. There is no indication either as to one track being used as one of the engagement means in connection with a fault in order to increase safety.

SUMMARY

An aspect relates to an alternative arrangement for secure transfer of a trolley from one suspended rail to another, and to provide a reliable and secure arrangement.

According to embodiments of the present invention, this is achieved by an arrangement of the kind mentioned in the introduction, which is peculiar in that the first and third engagement means or devices each includes a projecting part, and that the second and fourth engagement means or devices each include a track adapted to receive respective projecting parts, wherein both tracks are curving such that respective projecting parts are displaced in relation to the longitudinal direction of the rails by insertion into the respective tracks.

Hereby is indicated an alternative arrangement for secure transfer of a trolley from one suspended rail to another.

The arrangement can be used in connection with a hoisting system where the load is suspended from a rail. For example, a system with a rail having a slot in which a travelling trolley is mounted, and where a hoisting system is suspended from the trolley.

This does not limit the use as the arrangement can be used in all applications in which there is a rail with a free end, wherein a releasable barrier is to be formed that will safeguard a hoisting system against passing beyond the free end.

The load can be a person or goods.

In an embodiment of the invention, the first engagement means or device is provided on the first rail, and that the second engagement means or device is provided on the second rail, while the third engagement means or device is provided on the second rail, and that the fourth engagement means or device is provided on the first rail.

Hereby is achieved that engagement between the two pairs of engagement means or devices only occurs when the rails are aligned. The engagement means or device are not engaged in all other positions. It is hereby ensured that the trolley cannot inadvertently pass the free end of the rails as the stops form barriers in all positions except those where the rails are aligned. The system is automatic and does not require any human intervention to operate.

The engagement means or device drive the pivoting of the stops between their closed and open positions, as the first and third engagement means or device are coupled with the second and fourth engagement means or devices, respectively.

Embodiments of the invention have a particular advantage compared with the system indicated in WO 2013/122538 A1. In connection with insertion of the trolley on the rail in this system, it is necessary to lift the cylindrical pin manually in order for the trolley to pass by the stop and in onto the rail.

By an arrangement according to embodiments of the invention it is possible move the trolley past the stop and in onto the rail without manually operating the stop, as the stop can be arranged such that it automatically pivots out of the path of the trolley when the trolley has contact with the stop from a direction from outside and into the rail. Pivoting instead of translation provides that the force by which the stop is to be actuated in order to pivot out of the path of the trolley is relatively small.

Compared with GB 711857 A and GB 703061 A, the arrangement provides a particularly simple way of moving the stops between their closed and open positions. However, it is only the first and third engagement means or devices that have movable parts. The tracks as such are very reliable as they do not have any movable parts.

Moreover, there is additional safety connected with using a track as one of the engagement means or device in connection with a fault where the stop, for some reason or another, is blocked so that the stop is locked either in open position or in closed position.

If the stop is locked in open position while the rails are aligned, the track together with the projecting part coupled with the stop will prevent the rails from being moved to a position where the engagement means or device disengage. The potentially dangerous situation where the trolley inadvertently can leave the rails beyond the free end will thereby be avoided automatically.

If the stop fails in locked position, the track together with the projecting part coupled with the stop will prevent the engagement means or device from engaging and prevent the rails from being moved to a position in which the engagement means or device are aligned.

By the above mentioned two fault situations it will be apparent to the user that the automatic arrangement is not operating, and that repair is required before further operation can be performed.

According to a further embodiment, the arrangement according to the invention is peculiar in that the tracks are adapted with a recess disposed such that the projecting parts are in the recess when the rails are aligned.

A centering effect is hereby achieved where the rails will remain aligned under the action of the engaging means or device. The rails are to be applied a force large enough to get the projecting parts out of the recess before they can be displaced off the alignment. Thus it will be easier to align the rails.

According to a further embodiment, the arrangement according to the invention is peculiar in that the first stop includes a first elastic mechanism adapted so as to urge the first stop against its closed position, and that the second stop includes a second elastic mechanism adapted so as to urge the second stop against its closed position.

Hereby is achieved that the stop is provided a preferred position which is the closed position.

The elastic mechanism may include one or more spring means or devices.

According to an embodiment, the arrangement according to the invention is peculiar by including two independent spring means or devices.

Hereby is achieved additional security as the functionality of the arrangement is maintained even by failure of one of the spring means or devices.

According to a further embodiment, the arrangement according to the invention is peculiar in that the first stop and the second stop each includes a pivot plate arranged so as to be pivoted into the path of the trolley in the closed position of the stop, and so as to be pivoted out of the path of the trolley in the open position of the stop.

In an embodiment of the arrangement according to the invention, the pivot plate is formed with a straight side where it is in contact with the trolley in the closed position of the stop, and with an inclining contact face at the opposite side such that the trolley can push the stop aside when the trolley is inserted on the rail.

Hereby is achieved that the trolley can be moved into the rail in a simple way, without deactivating the stop.

According to a further embodiment, the arrangement according to the invention is peculiar in that the first engagement means or device is fixed to the first rail, and that the second engagement means or device is fixed to the second rail.

By the term "fixed to" in the present description is understood an element which is secured in relation to another element, but not necessarily fastened directly to the other element. In case of a movable second element, the first element will therefore follow the second element at a fixed relative position.

According to a further embodiment, the arrangement according to the invention is peculiar in that the third engagement means or device is fixed to the second rail, and that the fourth engagement means or device is fixed to the first rail.

Hereby, the same advantages as by the above mentioned embodiment are achieved.

BRIEF DESCRIPTION

Some of the embodiments will be described in detail, with reference to the following figures, wherein like designations denote like members, wherein.

Figure 1:
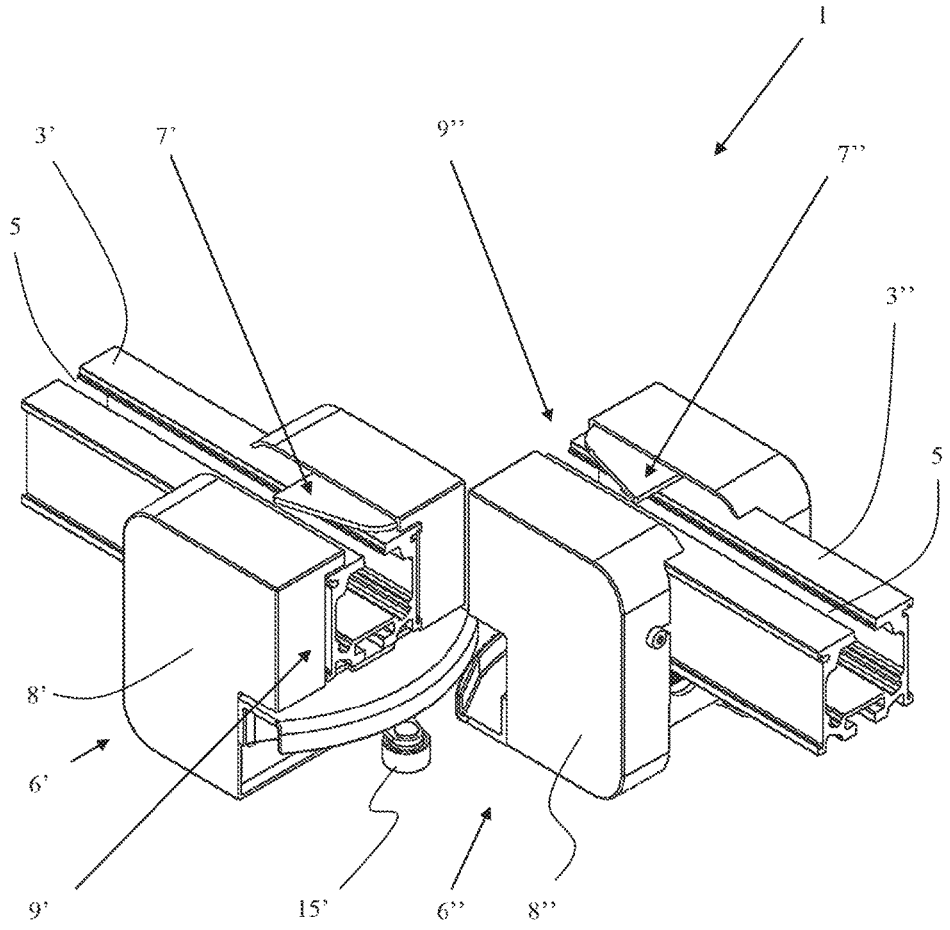
FIG. 1 shows an illustration of the arrangement according to embodiments of the invention where the rails are not aligned.
Figure 3A:
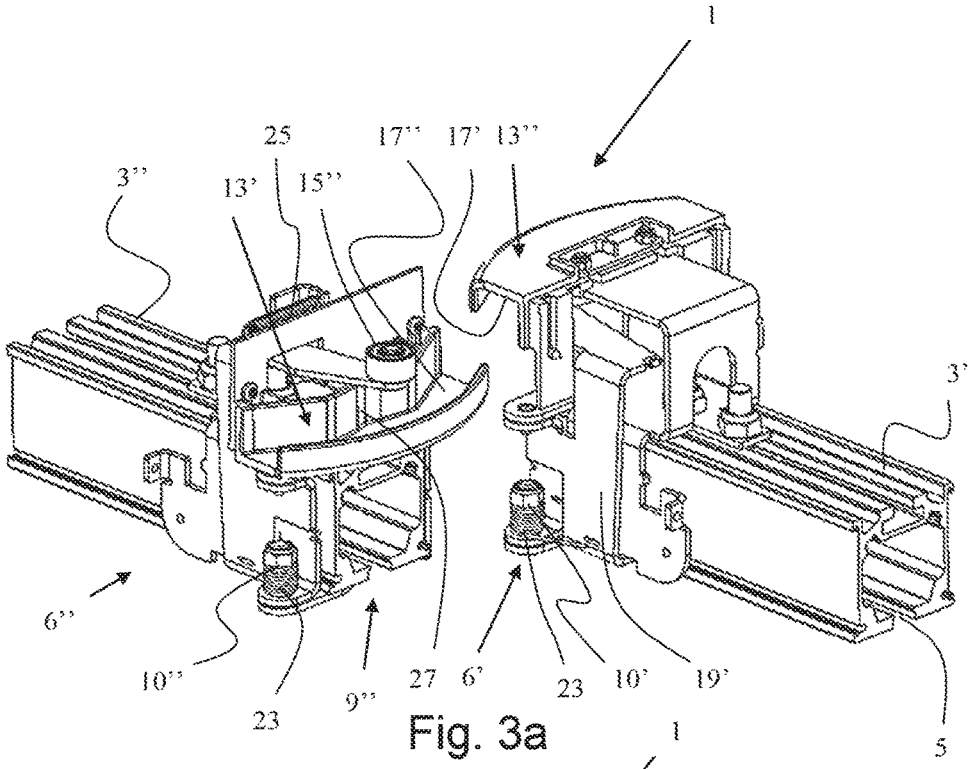
Figure 3B:
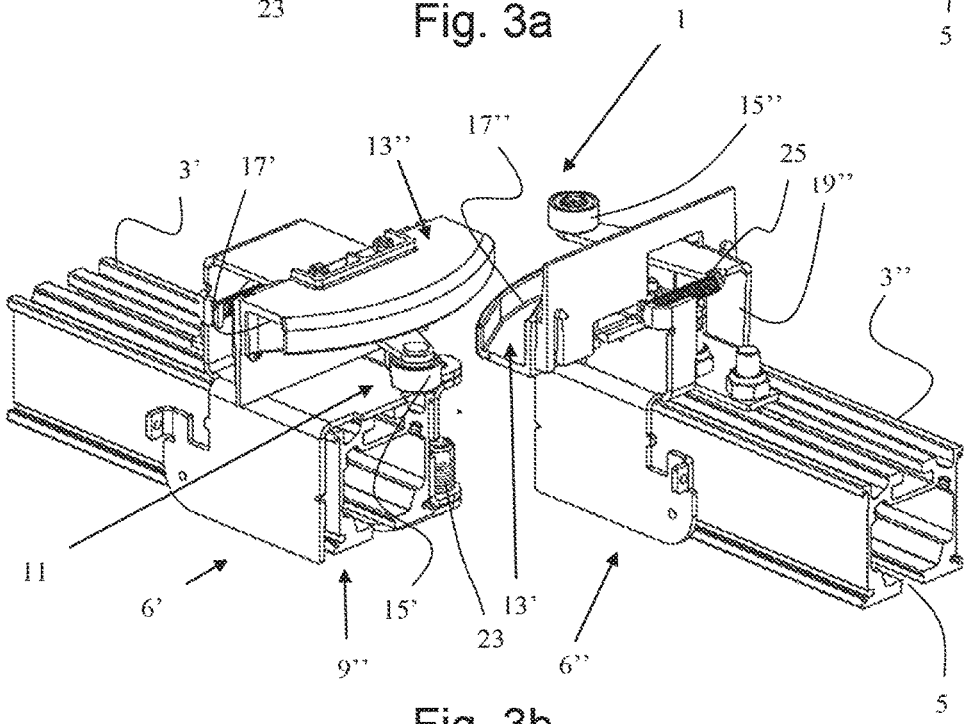
Figure 4:
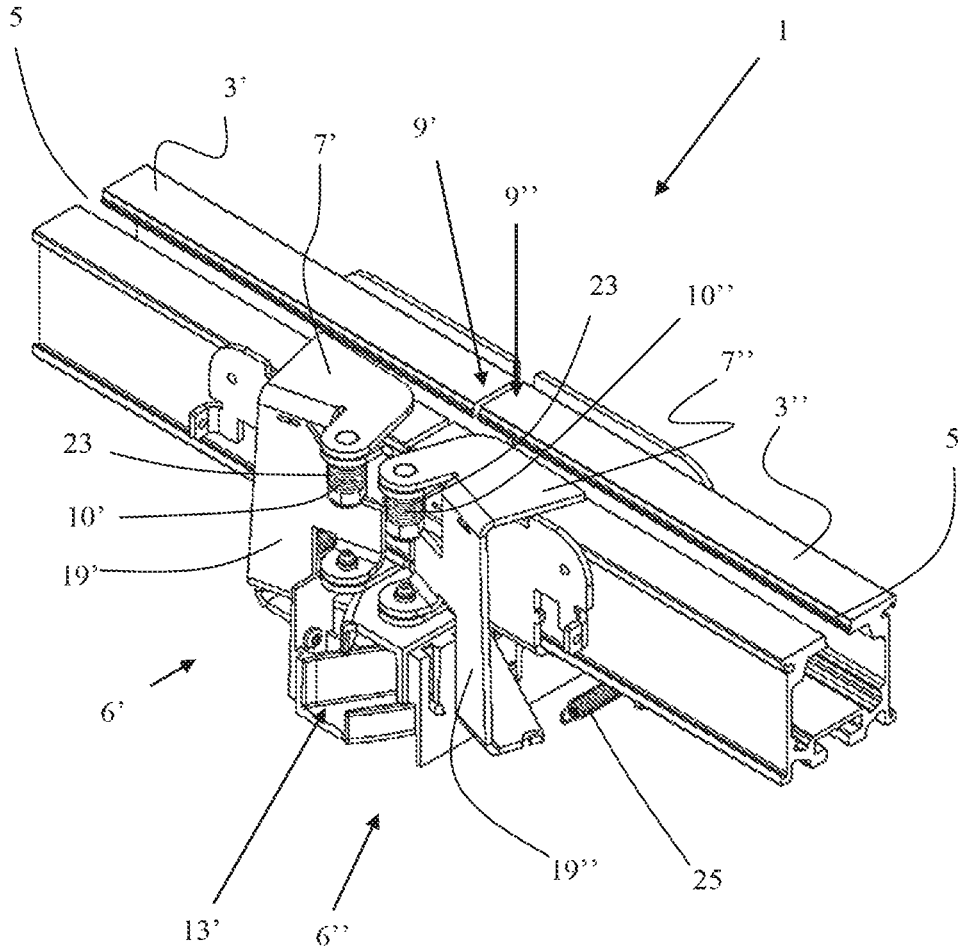
Figure 5:
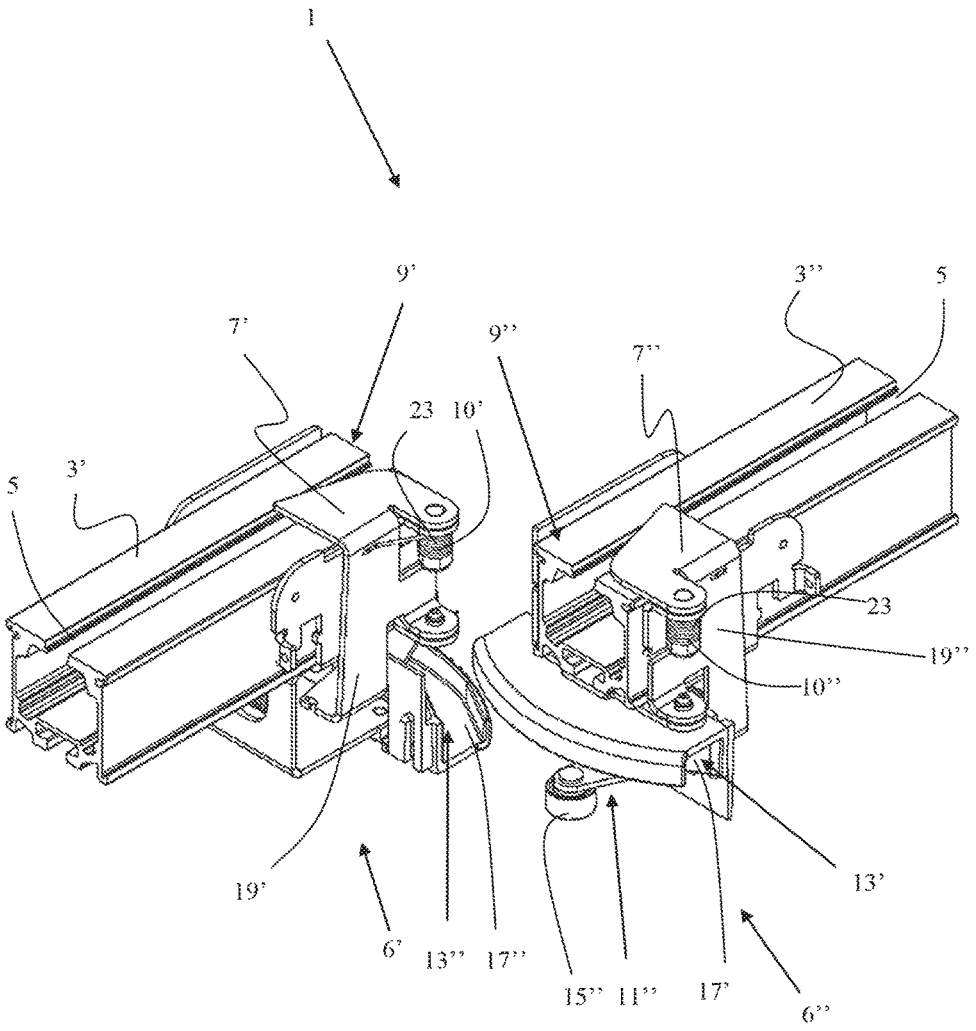

FIGS. 3*a-b* show an illustration of the arrangement in FIG. 1 as seen from above and from one and the other side, respectively, where the covers are hidden, and where the rails are not aligned;

FIG. 4 shows an illustration of the arrangement in FIG. 1 as seen from below where the covers are hidden and the rails are aligned; and FIG. 5 shows an illustration of the arrangement in FIG. 1 as seen from below where the covers are hidden and the rails are not aligned.

DETAILED DESCRIPTION

Figure 2:
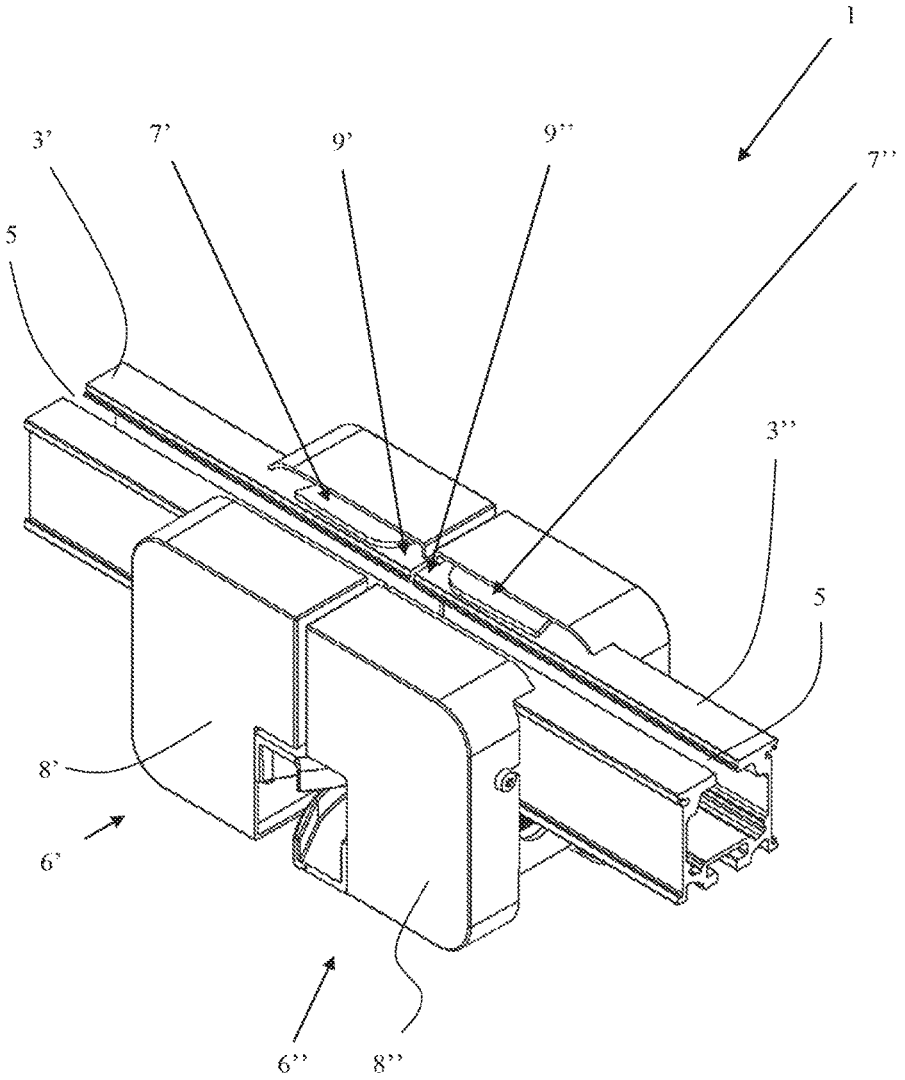
FIG. 2 shows an illustration of the arrangement in FIG. 1 where the rails are aligned.

FIGS. 1 and 2 show an arrangement 1 for secure transfer of a travelling trolley (not shown) between a first and a second rail 3'; 3" in a hoisting system (not shown). In FIGS. 1 and 2, the arrangement 1 and the rails 3', 3" are turned so that they are viewed from below.

The rails 3', 3" are of a type with a longitudinal slot 5 intended for receiving the trolley such that the wheels of the trolley can run inside the rails 3' 3", while a hoisting system is suspended from the trolley. The path of the trolley therefore follows the slot 5.

In the shown embodiment, the arrangement 1 is shown in two parts, a first part 6' mounted on the first rail 3', and a second part 6" mounted on the second rail 3".

The arrangement 1 includes a first stop 7' integrated in the first part 6' and a second stop 7" integrated in the second part 6".

On FIGS. 1 and 2, the first and second parts 6', 6" are each shown with a cover 8', 8" shielding the mechanisms of the arrangement.

On FIG. 1, where the rails 3', 3" are offset, the first and second stop 7', 7" are in their closed positions. The stops 7', 7" hereby form a barrier in the path of the trolley, preventing passage of the trolley past the free ends 9', 9" of the first and the second rail, respectively, from a position farther in on the respective rail 3', 3".

On FIG. 2, where the rails are aligned, the first and second stops 7', 7" are in their open positions. The stops 7', 7" are moved outside the path of the trolley such that the trolley can pass unhinderedly from one rail to the other 3', 3". The trolley can hereby pass by the free end 9', 9" of the first or the second rail, respectively, from a position farther in on the respective rail 3', 3".

The first and second stops 7', 7" change between closed and open positions by pivoting about a first and a second journal 10', 10', respectively,' that define an axis of rotation, see FIG. 3*a*.

FIGS. 3*a-b* show an illustration of the arrangement 1 in FIG. 1 as seen from above and from one and the other side, respectively, where the covers 8', 8" are hidden such that other parts of the arrangement can be seen, and where the rails 3', 3" are not aligned.

The arrangement 1 furthermore includes a first and a second engagement means or devices 11', 13'. In the shown embodiment, the first engagement means or device 11' is fixed to the first rail 3', and that the second engagement means or device 13' is fixed to the second rail 3". The first and a second engagement means or devices 11', 13' are arranged to engage when the rails 3', 3" are aligned. When the rails 3', 3" are sufficiently displaced, the engagement between the first and the second engagement means or devices 11', 13' will cease.

The first engagement means or device 11' is coupled with the first stop 7' such that the first stop 7' pivots out of the path of the trolley when the first and second engagement means or devices 11', 13' engage.

In the shown embodiment, the first engagement means or devices 11' is provided with a first projecting part 15' in the form of a wheel, see FIG. 3*b,* and the second engagement means or device 13' is a curving first track 17'. Moreover, the projecting part 15' is fastened to a bent first plate member 19'. The first stop 7' is integrated in the first plate member 19' in the form of a pivot plate 20 arranged so as to be pivoted into the path of the trolley in the closed position of the stop, and so as to be pivoted out of the path of the trolley in the open position of the stop. The plate member 19' is furthermore pivotably suspended by the first journal 10'.

The curvature of the first track 17' is adapted such that the projecting part 15' is displaced in relation to the longitudinal direction of the rail when the first projecting part 15' is inserted into the track 17'. This displacement causes the first plate member 19' to rotate about the first journal 10' such that the first stop 7' is pivoted in relation to the first rail 5' into a position outside the path of the trolley.

The first stop 7' includes a first elastic mechanism. The elastic mechanism is adapted such that it acts on the first plate member 19' with a force urging the first stop 7' against its closed position. In the shown embodiment, the first elastic mechanism includes both a torsion spring 23 and a extension spring 25. Redundancy is hereby achieved such that the function of the stop is not compromised if one of the springs fails.

In alternative embodiments, the elastic mechanism may include one or more spring means or devices selected among, but not limited to, torsion springs, extension springs, compression springs and/or helical springs.

The arrangement 1 furthermore includes a third and a fourth engagement means or devices 11", 13". In the shown embodiment, the third engagement means or device 11" is fixed to the second rail 3", and the fourth engagement means or device 13" is fixed to the first rail 3'. The third and a fourth engagement means or device 11", 13" are arranged to engage when the rails 3', 3" are aligned. When the rails 3', 3" are sufficiently displaced, the engagement between the third and the fourth engagement means or devices 11", 13" will cease.

The third engagement means or device 11" is coupled with the second stop 7" such that the second stop 7" pivots out of the path of the trolley when the third and fourth engagement means or devices 11", 13" engage.

In the shown embodiment, the third engagement means or device 11" is provided with a second projecting part 15" in the form of a wheel, and the fourth engagement means or device 13" is a curving second track 17". Moreover, the second projecting part 15" is fastened to a bent second plate member 19". The second stop 7" is integrated in the second plate member 19" in the form of a pivot plate 20 arranged so as to be pivoted into the path of the trolley in the closed position of the stop, and so as to be pivoted out of the path of the trolley in the open position of the stop. The plate member 19" is furthermore pivotably suspended by the second journal 10".

The curvature of the second track 17" is adapted such that the projecting part 15" is displaced in relation to the longitudinal direction of the rail when the projecting part 15" is inserted into the track 17". This displacement causes the second plate member 19" to rotate about the second journal 10" such that the second stop 7" is pivoted in relation to the second rail 5" into a position outside the path of the trolley.

The second stop 7" includes a second elastic mechanism. The second elastic mechanism is adapted such that it acts on the second plate member 19" with a force urging the second stop 7" against its closed position. In the shown embodiment, the second elastic mechanism includes both a torsion spring 23 and a extension spring 25. Redundancy is hereby achieved such that the function of the stop is not compromised if one of the springs fails.

The tracks 17', 17" are each adapted with a recess 27, see FIG. 3*a*. The recesses 27 are disposed such that the respective projecting parts 15', 15" are in the recess 27 when the rails are aligned. This will provide a centering effect so that the rails 3', 3" remain in the aligned position until they are moved intentionally.

FIG. 4 shows an illustration of the arrangement 1 in FIG. 1 as seen from below where the covers 8 are hidden and where the rails 3', 3" are aligned. FIG. 5 shows the same arrangement 1 as FIG. 4 with aligned rails 3', 3".

It is clearly seen here how the stops 7', 7" by pivoting the plate members 19', 19" under action of the engaging means or device 11', 11", 13', 13" shift between closed and open positions.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. An arrangement for secure transfer of a travelling trolley between a first and a second rail in a hoisting system, the arrangement including:

a first stop which in an open position is arranged to allow passage of the trolley from the first rail to the second rail when the rails are aligned, and which in a closed position is arranged to form a barrier in the path of the trolley, preventing passage of the trolley past the free end of the first rail when the rails are not aligned;

a second stop which in an open position is arranged to allow passage of the trolley from the second rail to the first rail when the rails are aligned, and which in a closed position is arranged to form a barrier in the path of the trolley, preventing passage of the trolley past the free end of the second rail when the rails are not aligned;

a first and a second engagement device arranged to engage when the rails are aligned;

a third and a fourth engagement device arranged to engage when the rails are aligned;

the first stop arranged so as to pivot in relation to the first rail, and such that the first stop is coupled with the first engagement device so that the first stop pivots out of the path of the trolley when the first and second engagement device engage;

the second stop arranged so as to pivot in relation to the second rail, and such that the second stop is coupled with the third engagement device so that the second stop pivots out of the path of the trolley when the third and fourth engagement device engage; wherein the first and third engagement device each includes a projecting part, and that the second and fourth engagement device each include a track adapted to receive respective projecting parts, wherein both tracks are curving such that respective projecting parts are displaced in relation to the longitudinal direction of the rails by insertion into the respective tracks.

2. The arrangement according to claim 1, wherein the tracks are adapted with a recess disposed such that the projecting parts are in the recess when the rails are aligned.

3. The arrangement according to claim 1 wherein the first stop includes a first elastic mechanism adapted so as to urge the first stop against its closed position, and that the second stop includes a second elastic mechanism adapted so as to urge the second stop against its closed position.

4. The arrangement according to claim 1, wherein the first stop and the second stop each includes a pivot plate arranged so as to be pivoted into the path of the trolley in the closed position of the stop, and so as to be pivoted out of the path of the trolley in the open position of the stop.

5. The arrangement according to claim 1, wherein the first engagement device is fixed to the first rail, and that the second engagement device is fixed to the second rail.

6. The arrangement according to claim 1, wherein the third engagement device is fixed to the second rail, and that the fourth engagement device is fixed to the first rail.

* * * * *